United States Patent [19]

Putney

[11] 4,320,649

[45] Mar. 23, 1982

[54] CABLE STRAIGHTENER

[76] Inventor: Buddy S. Putney, 2515 E. Sweetwater Ave., Phoenix, Ariz. 85032

[21] Appl. No.: 26,930

[22] Filed: Apr. 4, 1979

[51] Int. Cl.[3] ..... B21B 7/06

[52] U.S. Cl. ..... 72/389; 72/457; 140/147

[58] Field of Search ..... 72/389, 380, 384, 386, 72/387, 457, 458, 369, 453.15; 140/147

[56] References Cited

U.S. PATENT DOCUMENTS

| | | | |
|---|---|---|---|
| 630,484 | 8/1899 | Brown | 72/389 |
| 2,360,171 | 10/1944 | Smith | 72/453.15 |
| 2,407,040 | 9/1946 | Taramaschi | 140/147 |
| 2,740,435 | 4/1956 | Pritts | 140/147 |
| 3,209,577 | 10/1965 | Teplow | 72/389 |
| 3,848,450 | 11/1974 | Dehlbom | 72/384 |
| 4,210,014 | 7/1980 | Taylor | 72/389 |

*Primary Examiner*—Gene P. Crosby
*Attorney, Agent, or Firm*—Harry M. Weiss

[57] ABSTRACT

An apparatus for removing kinks in steel cable includes two transverse members coupled together in spaced relationship and each supported by a pair of legs. A striking member is supported by and pivotably coupled to the transverse members. Compressed air is coupled through an air valve to an air can which, when activated, forces a portion of the striking member down towards the transverse members. A damaged cable is positioned on the transverse members so as to be struck by the striking member at a desired point.

2 Claims, 4 Drawing Figures

CABLE STRAIGHTENER

BACKGROUND OF THE INVENTION

1. Field of the Invention

This invention relates generally to an apparatus for straightening cable and, more particularly, to an air powered apparatus for removing sharp bends (kinks) in steel cable.

2. Description of the Prior Art

Steel cable has long been used in the logging industry to haul and secure logs. Due to the large forces exerted on these cables and the irregular nature of the terrain in which the cables are used, the cables often suffer severe bends, commonly referred to as kinks, which render the cables unsuitable for future use. In the absence of suitable means for straightening the cables in the field, they must be replaced resulting in loss of time and additional expense.

SUMMARY OF THE INVENTION

It is an object of the present invention to provide an apparatus for removing kinks from steel cable.

It is a further object of the invention to provide a cable straightener which is portable and easily deployed in the field.

It is a still further object of the invention to provide an apparatus for removing cable kinks which is energized by a field source of compressed air.

Finally, it is an object of the invention to provide an apparatus for removing cable kinks which is simple and easy to operate by a single person.

According to a broad aspect of the invention there is provided an apparatus for straightening cable comprising first means for supporting said cable; striking means pivotably coupled to said first means for striking said cable at a desired point; and second means for activating said striking means.

The above and other objects, features and advantages of the present invention will be better understood from the following detailed description taken in conjunction with the accompanying drawings, in which:

DESCRIPTION OF THE PREFERRED EMBODIMENT

Figure 1A:
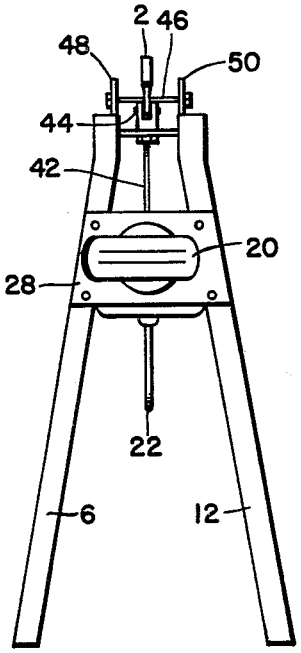
FIG. 1*a* is a front view of the inventive cable straightening apparatus.
Figure 1B:
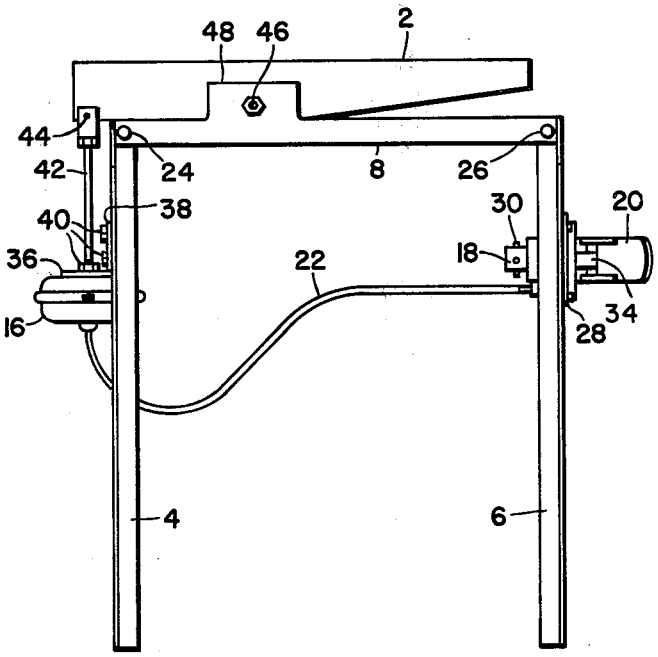
FIG. 1*b* is a side view of the apparatus shown in FIG. 1*a*.
Figure 1C:
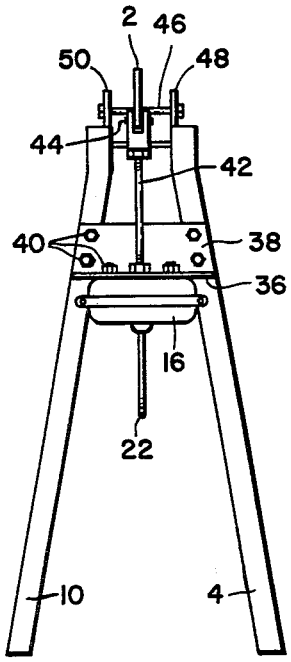
FIG. 1*c* is a rear view of the apparatus shown in FIG. 1*a*.

Referring to FIGS. 1*a*–1*c*, there is shown a portable cable straightening apparatus comprising a striking member or lever 2, a first pair of generally inclined legs 4 and 6 coupled together at their upper ends by transverse support member 8, a second pair of generally inclined legs 10 and 12 coupled together at their upper ends by transverse support member 14, an air can 16, an air valve 18, an actuator 20 and an air hose 22 for delivering air under pressure from the actuator/valve assembly 18 and 20 to the air can 16.

Figure 2:
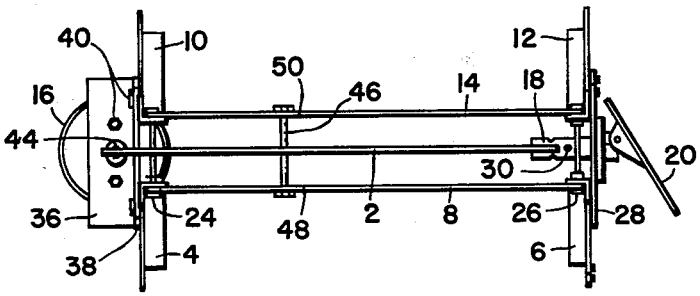
FIG. 2 is a top view of the inventive cable straightening apparatus.

Transverse members 8 and 14 are coupled together in spaced relationship by nut and bolt assemblies 24 and 26 as is more clearly shown in FIG. 2 which is a top view of the apparatus shown in FIGS. 1*a*–1*c*. To facilitate coupling of the transverse members to their associated legs and to each other, legs 4, 6, 10 and 12 are preferably L-shaped steel members. Such members also provide the strength and stability required during operation of the apparatus.

Coupled to legs 6 and 12, by means of, for example, bolts 32, is a plate 28 to which an actuator lever on pedal 20 is hingedly coupled. Also coupled to plate 28 is air valve 18 which may be coupled at 30 to a source of compressed air, for example at a pressure of 120 p.s.i.

When pedal 20 is pivoted inwardly so as to engage and depress plunger member 34, air under pressure is allowed to pass through valve 18 into hose 22. The compressed air is delivered via hose 22 to air can 16 of the type used in air brake systems. Air can 16 is coupled to a horizontal surface 36 of an L-shaped support plate, the vertical surface 38 of which is fixedly coupled to legs 10 and 4. This coupling is accomplished, for example, by a nut and bolt assemblies 40.

A vertically movable stem 42 protrudes from air can 16 and is pivotably coupled to striking member 2 at 44. Striking member 2 is likewise pivotably coupled at 46 to plates 48 and 50 which are integral with transverse members 8 and 14 respectively.

In operation, a piece of cable would be placed over transverse member 8 and 14 so that a kink therein would lie beneath striking member 2. Assuming that the operator is holding the cable in proper position and orientation with his hands, he may depress actuator 20 with, for example, an upper portion of his leg. When plunger 34 is sufficiently depressed by actuator 20, compressed air will pass through valve 18 and air hose 22 to air can 16. Member 42 will be forced upward carrying with it the rear portion of striking member 2 which is coupled to member 42 at 44. Since striking member 2 is also pivotably coupled to plates 48 and 50, the inclined edge of striking member 2 will be pushed downward. If the cable is properly positioned, member 2 will strike the kink in the cable tending to straighten the cable.

The above described apparatus is very stable and may be easily deployed in the forest, i.e. the site of the actual logging operations. The inventive cable straightener requires no source of energy other than a source of compressed air which may be easily carried by other logging equipment such as a yarder.

While the invention has been described with reference to a specific embodiment thereof, it should be clear to those skilled in the art that changes in form and details may be made therein without departing from the spirit and scope of the invention.

What is claimed is:

1. An apparatus for straightening cable, comprising:

first means disposed to permit said cable to be positioned for supporting said cable;

striking means pivotably coupled to said first means for striking said cable at a desired point;

said striking means provided with inclined surface means for permitting kinks exhibiting various degrees of distortion to be positioned along said first means in a tranverse direction thereto and in communication with at least a portion of said inclined surface of said striking means at a location in proportion to said degree of distortion;

means having an actuator pedal for activating said striking means;

said first means comprising first and second substantially horizontal supporting members coupled together in a spaced relationship;

said striking means further comprising a lever having first and second ends;

said first end coupled to said activating means;

said second end for striking said cable;

said lever pivotably coupled to said first means at a point on said lever intermediate said first and second ends;

said striking means yet further comprising third means coupled to said first end and capable of upward movement; and said striking means still further comprising fourth means for supplying said third means with compressed air to initiate said upward movement.

2. An apparatus for straightening cable, comprising:

first means disposed to permit said cable to be positioned for supporting said cable;

striking means pivotably coupled to said first means for striking said cable at a desired point;

said striking means provided with inclined surface means for permitting kinks exhibiting various degrees of distortion to be positioned along said first means in a transverse direction thereto and in communication with at least a portion of said inclined surface of said striking means at a location in proportion to said degree of distortion;

means having an actuator pedal for activating said striking means;

said first means comprising first and second substantially horizontal supporting members coupled together in a spaced relationship;

said striking means further comprising a lever having first and second ends;

said first end coupled to said activating means;

said second end for striking said cable;

said lever pivotably coupled to said first means at a point on said lever intermediate said first and second ends; and said activating means comprising an air can having a movable stem pivotally coupled to said first end of said lever, an air valve having said actuator pedal, and a hose pneumatically coupling said air can to said air valve so that opening said valve delivers the compresed air to said air can and causes said stem to move to pivot said lever.

* * * * *